United States Patent [19]

Lin

[11] Patent Number: 5,020,837

[45] Date of Patent: Jun. 4, 1991

[54] TUBULAR DOOR LOCK WITH PLATE SHAPED BOLT ACTUATOR

[75] Inventor: Jui C. Lin, Kaohsiung, Taiwan

[73] Assignee: Taiwan Fu Hsing Industry Co., Ltd., Kaohsiung, Taiwan

[21] Appl. No.: 556,184

[22] Filed: Jul. 23, 1990

[51] Int. Cl.[5] ..... E05C 1/16

[52] U.S. Cl. ..... 292/169.13; 292/337; 292/DIG. 74

[58] Field of Search ..... 292/DIG. 60, 337, 169.13, 292/224, 1, 169, 167, DIG. 74; 70/224

[56] References Cited

U.S. PATENT DOCUMENTS

| | | | |
|---|---|---|---|
| 2,645,512 | 7/1953 | Netschert | 292/169.13 |
| 2,648,560 | 8/1953 | Quigley et al. | 292/169.13 |
| 2,656,207 | 10/1953 | Russell et al. | 292/169.13 |
| 2,736,597 | 2/1956 | Russell | 292/169.13 |
| 4,615,549 | 10/1986 | Conture | 292/337 |
| 4,687,239 | 8/1987 | Lin | 292/337 |
| 4,750,766 | 6/1988 | Shen | 292/337 |
| 4,767,140 | 8/1988 | Lin | 292/DIG. 60 |
| 4,820,330 | 4/1989 | Lin | 70/224 |
| 4,890,871 | 1/1990 | Lin | 292/337 |

*Primary Examiner*—Eric K. Nicholson

*Attorney, Agent, or Firm*—Fleit, Jacobson, Cohn, Price, Holman & Stern

[57] ABSTRACT

A tubular door lock (1) has an actuating plate member (4) of metal formed by pressing and provided with a square shaft hole (42) and four square projections (43) around the square shaft hole to fit in a round opening (22, 32) of either of two assembling plates (2, 3) between which the actuating plate (4) is disposed when assembled. The actuating plate is rotated by rotation of the square shaft so that cams (44) thereon engage teeth (13) on bolt plate (11) to retract the bolt (12).

1 Claim, 3 Drawing Sheets

TUBULAR DOOR LOCK WITH PLATE SHAPED BOLT ACTUATOR

BACKGROUND OF THE INVENTION

This invention relates to tubular door locks and more particularly to such door locks having an actuator made by pressing of a metal plate to form a plate shaped actuator for reciprocally operating the bolt by rotation of the actuator.

There is a tubular door lock disclosed in the U.S. Pat. No. 4,687,239, wherein a fan-shaped gear 23 is provided with an axial rectangular shaft hole 231 for a rectangular shaft to pass through. The fan-shaped gear 23 is usually made up of two parts, requiring a rather large thickness to fit in and rotate in the holes 51 in two assembling plates 5. Therefore, its manufacture involves inconvenience and complexity resulting in high cost.

SUMMARY OF THE INVENTION

This invention has the object of improving the structure of the fan-shaped gear 23, so that it can be made with more simplicity and cheapness, but still having the same function.

The tubular door lock in the present invention comprises an actuating plate especially designed to be substituted for the fan-shaped gear in a conventional tubular door lock.

The actuating plate is provided with a square shaft hole for the square shaft to pass through for mutual movement, and four square projections around the square shaft hole bent upright sidewise to the right or to the left so as to fit in and rotate along the edge of a round opening in either of two assembling plates, between which the actuating plate is to be assembled. The actuating plate is also provided having a fan-shaped forward edge with two humps as cams to engage and move two teeth on the pulling or bolt plate.

When the actuating plate is rotated by the square shaft, the humps or cams of the fan-shaped edge of the plate are also rotated to move thereby pushing the teeth of the pulling plate, which is then retracted inward, or extended outward for retracting in or extending out the dead bolt.

BRIEF DESCRIPTION OF THE DRAWINGS

The invention will now be described in detail with reference to the accompanying drawings, wherein.

DETAILED DESCRIPTION OF THE INVENTION

Figure 1:
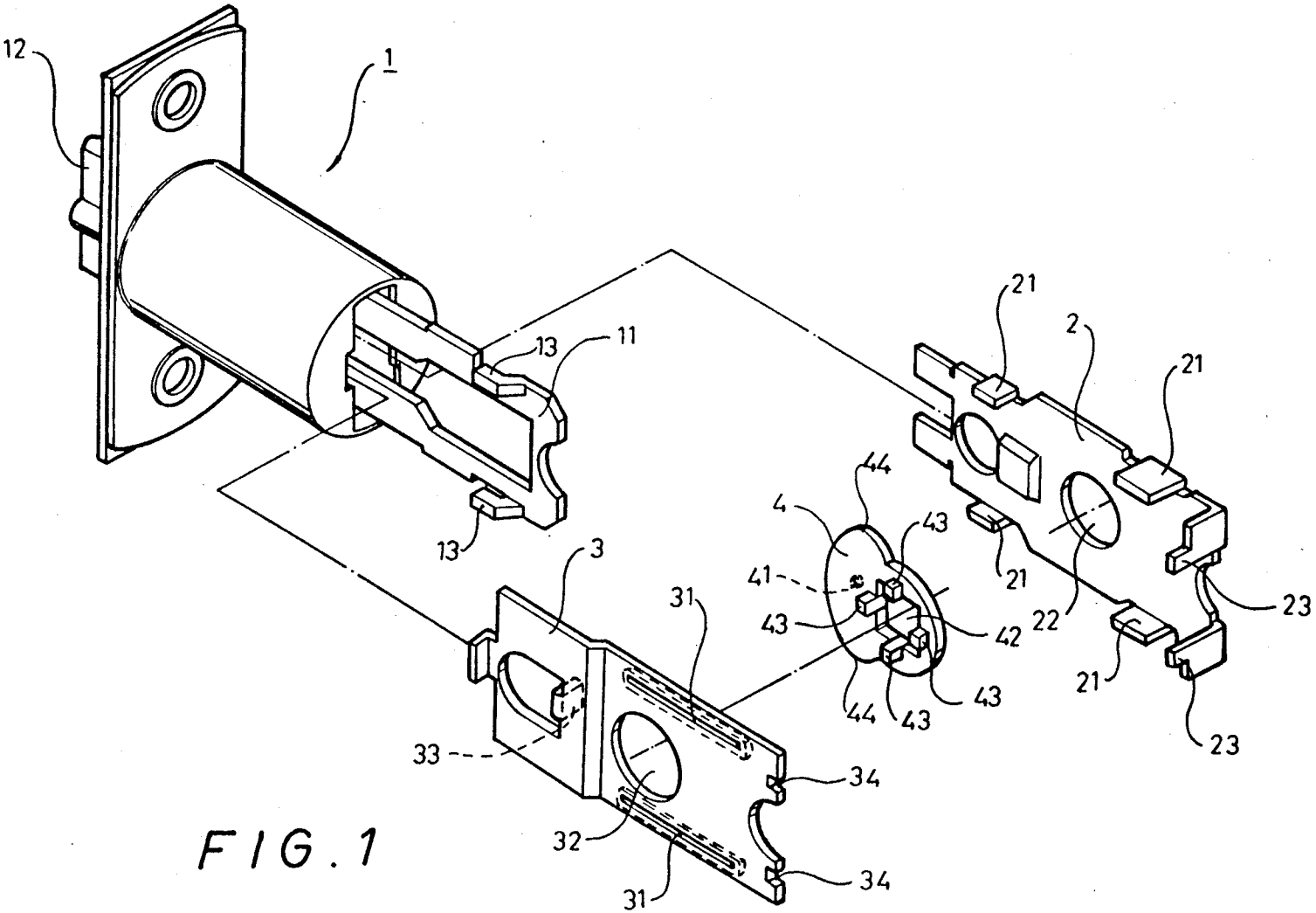
FIG. 1 is an exploded perspective view of the tubular door lock of the present invention.
Figure 2:
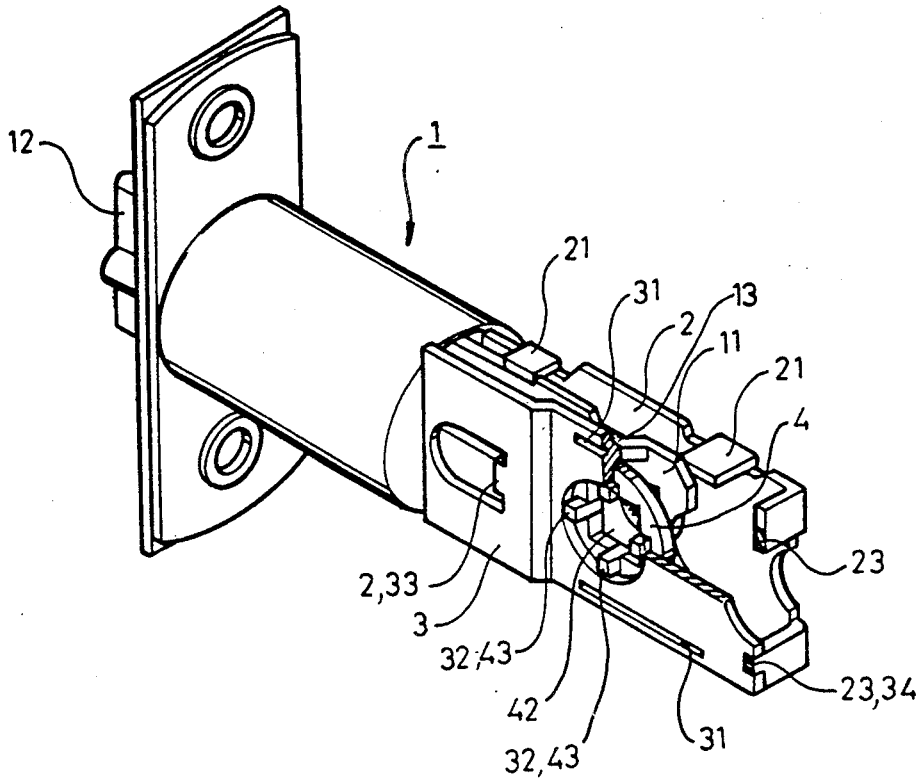
FIG. 2 is a perspective view of the tubular door lock assembly in accordance with the present invention.
Figure 3:
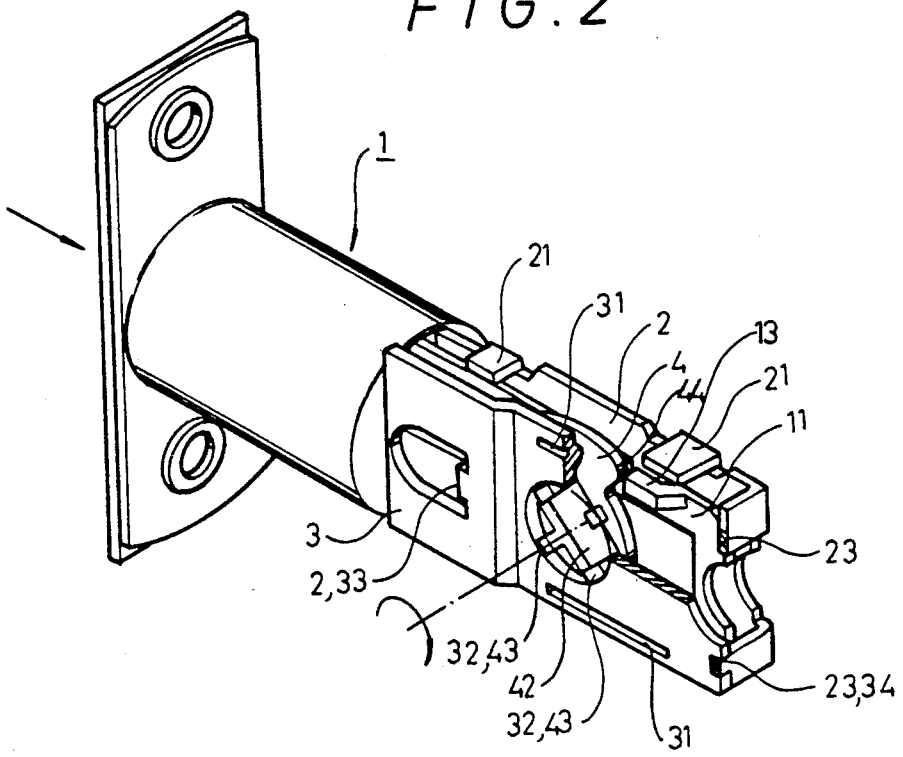
FIG. 3 is another actional view of the tubular door lock in the present invention.
Figure 4:
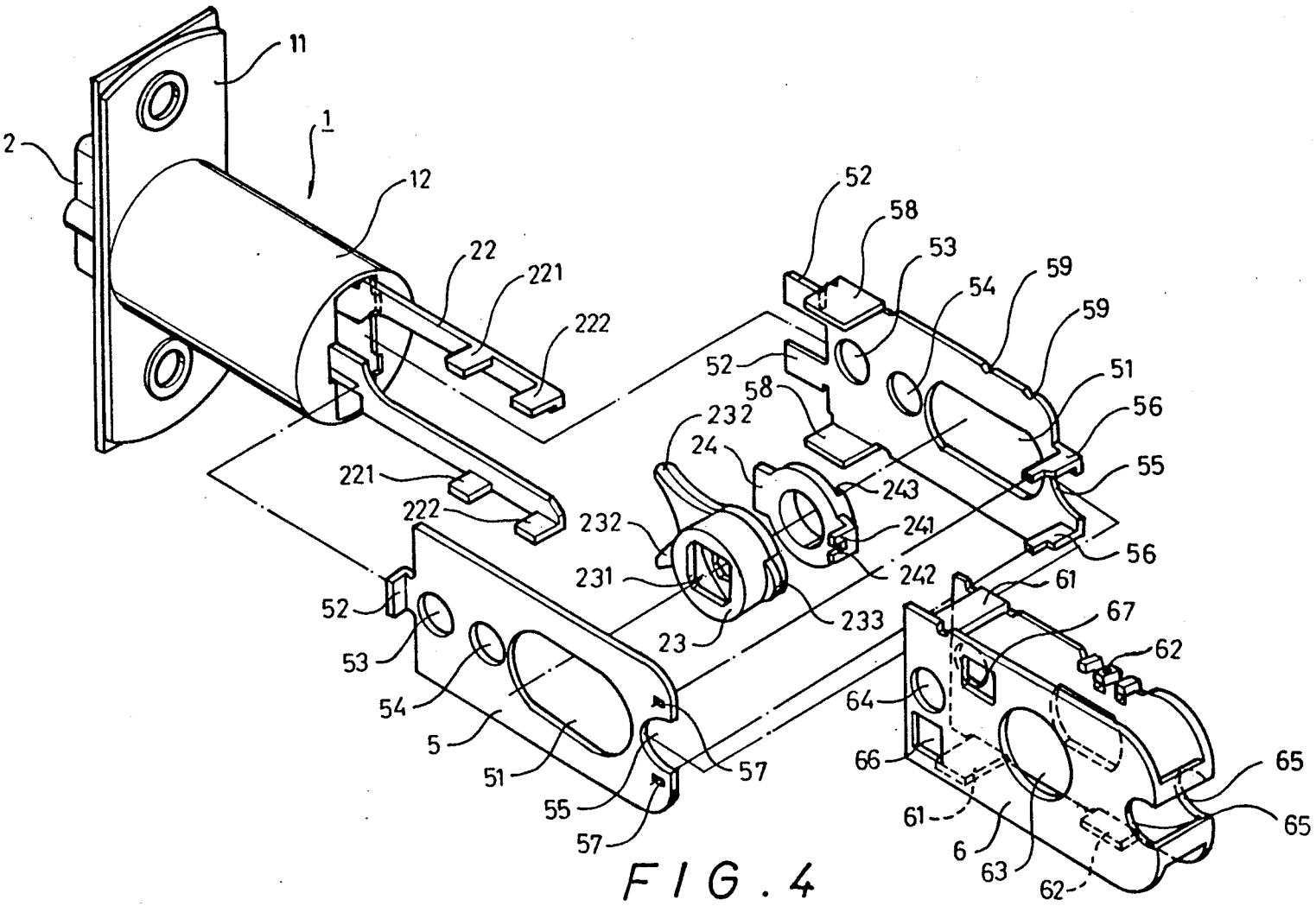
FIG. 4 is an exploded perspective view of a conventional tubular door lock.

As FIG. 1 shows, this tubular door lock in the present invention comprises a basic shell lock casing 1 and two assembling plates 2, 3. The assembling plate 3 is specially pressed to have an inward-bent section to reduce the distance between the two plates 2, 3 so as to give an actuating plate 4 a proper space to be assembled between them, and to prevent the actuating plate 4 from with surface to surface contact with the two plates 2,3. The assembling plate 3 is provided with two parallel rails 31 protruding inward and the actuating plate 4 is provided with a hump 41 to reduce the frictional resistance. Both assembling plates 2, 3 are respectively provided with a round opening 22, 32 aligned with each other and other holes as needed in a conventional tubular door lock. In order to assemble both plates 2, 3 together stabilized in position, both plates 2, 3 have respectively feet 21, 33 to push against each other, and two feet 23 to fit and stick in two position notches 34.

The actuating plate 4 is formed by a pressing process, and is provided with a square opening 42, four square projections 43 around the opening 42, which can be bent to either the left (as shown in FIG. 1) to fit in the round opening 32 in the plate 3 or to the right to fit in the round opening 22 in the plate 2 so that the actuating plate 4 can be kept stabilized in position and the four projections can slide along and rotate in the opening edge when said plate 4 is rotated by a square shaft. Thus, a square shaft passing through the square hole 42 can rotate the actuating plate 4, which has its fan-shaped side with two humps or cams 44 moved to push the two teeth 13 of the pulling or ball plate 11, which retracts or extends the dead bolt 12.

Accordingly, the improved structure of the actuating plate 4 reduces the number of molds for making it and shortens the process of manufacture thereby reducing the cost of the door lock.

I claim

1. In a tubular door lock for mounting on doors including two spaced assembling plates, an actuating plate rotatably mounted between the assembling plates and having actuating elements therein, a bolt operating plate mounted between the assembling plates for reciprocating movement and having abutment elements thereon engageable with the actuating elements so that rotation of said actuating plate reciprocates said bolt operating plate, and a bolt longitudinally slidably mounted and engaging with said bolt operating plate for extension and retraction thereby in response to rotation of said actuating plate, the improvement comprising:

a round hole in each assembling plate, said holes being aligned and forming circular edges on said assembling plates;

a square hole in said actuating plate for receiving a square shaft extending therethrough and through said aligned round holes;

four projections extending from one side of said actuating plate around said square hole extending into a round hole of one assembling plate and slidably engaging said circular edge of said one assembling plate to support and guide said actuating plate for rotational movement by rotation of a square shaft extending through said square hole;

two teeth on said bolt operating plate; and two cams on said actuating plate engageable with said two teeth, respectively, so that rotation of said actuating plate engages one of said cams with a respective one of said teeth for reciprocating the bolt operating plate and retracting the bolt.

* * * * *